United States Patent [19]

Hintsch

[11] 4,192,353

[45] Mar. 11, 1980

[54] CLOTH TAKE-UP SYSTEM

[75] Inventor: Otto Hintsch, Wallisellen, Switzerland

[73] Assignee: Sulzer Brothers Limited, Winterthur, Switzerland

[21] Appl. No.: 919,712

[22] Filed: Jun. 27, 1978

[30] Foreign Application Priority Data

Jul. 6, 1977 [CH] Switzerland ..... 8317/77

[51] Int. Cl.[2] ..... D03D 49/20

[52] U.S. Cl. ..... 139/307; 66/149 R

[58] Field of Search ..... 139/304, 307, 308; 66/147, 149, 151, 152

[56] References Cited

U.S. PATENT DOCUMENTS

| | | | |
|---|---|---|---|
| 646,614 | 4/1900 | Wyman | 139/308 |
| 872,061 | 11/1907 | Gordon | 139/308 |
| 1,649,080 | 11/1927 | Ross | 139/307 |
| 1,790,617 | 1/1931 | Brown | 139/308 |
| 2,293,666 | 8/1942 | Santon | 139/307 |
| 3,955,604 | 5/1976 | Braun | 139/308 |

FOREIGN PATENT DOCUMENTS

| | | | |
|---|---|---|---|
| 667986 | 7/1929 | France | 139/307 |
| 5115 | of 1879 | United Kingdom | 139/307 |

*Primary Examiner*—Henry Jaudon
*Attorney, Agent, or Firm*—Kenyon & Kenyon

[57] ABSTRACT

The cloth take-up system is provided with an additional deflecting element which is disposed in the path of travel of the cloth between a first deflection element and the take-up roller in order to increase the wrapping angle of the cloth about the take-up roller. This additional deflection element can be integrated with the first deflection element by means of a Y-shaped member. Also, a contact-pressure element is positioned to press the travelling cloth against the take-up roller.

14 Claims, 4 Drawing Figures

CLOTH TAKE-UP SYSTEM

This invention relates to a cloth take-up system for a weaving machine.

As is known, weaving machines have been provided with various types of cloth or fabric take-up systems. Generally, such systems are constructed with a deflecting beam or element, a cloth take-up roller, a deflection roller following the take-up roller and a cloth beam onto which the cloth is wound for delivery. However, it has been found that some types of cloth, particularly those made of thin filaments, slip on the take-up roller. This occurs frequently even if the deflecting roller is pressed against the cloth take-up roller. As a result, this can lead to faults in the cloth, for example a moire effect, and may also result in the cloth being wound unevenly on the cloth beam.

Accordingly, it is an object of the invention to preclude an uneven winding of a cloth on a cloth beam in a weaving machine.

It is another object of the invention to prevent the occurrence of a moire effect on a cloth wound onto a cloth beam of a weaving machine.

It is another object of the invention to provide a simple cloth take-up system for winding cloth on a cloth beam of a weaving machine.

It is another object of the invention to provide a simple means of modifying existing cloth take-up systems of weaving machines to preclude uneven winding of the cloth on the cloth beam.

Briefly, the invention provides a cloth take-up system which can be used in a weaving machine having means for forming a cloth. The take-up system includes a take-up roller for receiving a travelling length of cloth, a first deflection element adjacent the take-up roller to direct the travelling length of cloth to the take-up roller, a deflecting roller adjacent the take-up roller for receiving the travelling length of cloth from the take-up roller and a second deflection element having a non-rotatable deflecting surface disposed in the path of travel of the cloth between the first deflection element and the take-up roller. This second deflection element is positioned to deflect the cloth towards the take-up roller and deflecting roller in order to increase the wrapping angle of the cloth about the take-up roller. The take-up system also employs a cloth beam for winding on of the cloth after passage from the deflecting roller.

The two deflection elements can be integrated into a one piece member, for example of V-shape cross-section or Y-shape cross-section. Also, the second deflection element may be separably mounted from the first deflection element.

In order to facilitate the increased deflection of the cloth, the second deflection element is disposed in a space defined by the take-up roller and deflecting roller and a tangential plane common to these two rollers.

In addition, a contact-pressure element can be positioned between the second deflection element and the take-up roller in order to press the travelling cloth against the take-up roller.

These and other objects and advantages of the invention will become more apparent from the following detailed description taken in connunction with the accompanying drawings wherein:

FIG. 1 diagramatically illustrates a side elevational view of a weaving machine employing a take-up system in accordance with the invention;

Figure 1:
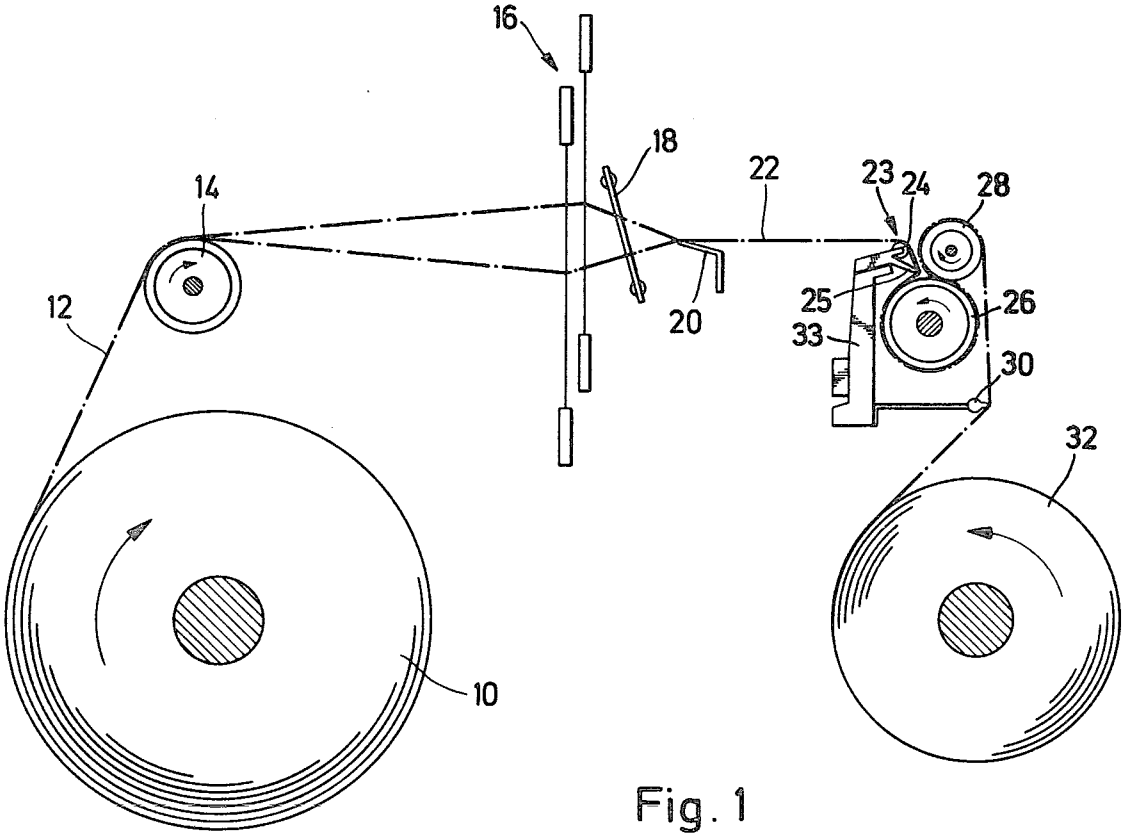

Referring to FIG. 1, the weaving machine is of generally conventional construction. As indicated, the weaving machine is adapted to receive a warp beam 10 at one end from which a plurality of warps 12 may pass over a tensioning beam 14 through a suitable means including, for example healds 16, a reed 18 and a cloth support 20 positioned adjacent to the reed 18 for forming a cloth or fabric 22. The machine also has a breast beam 23 at the opposite end which serves as a cloth deflecting means of a cloth take-up system.

Figure 3:
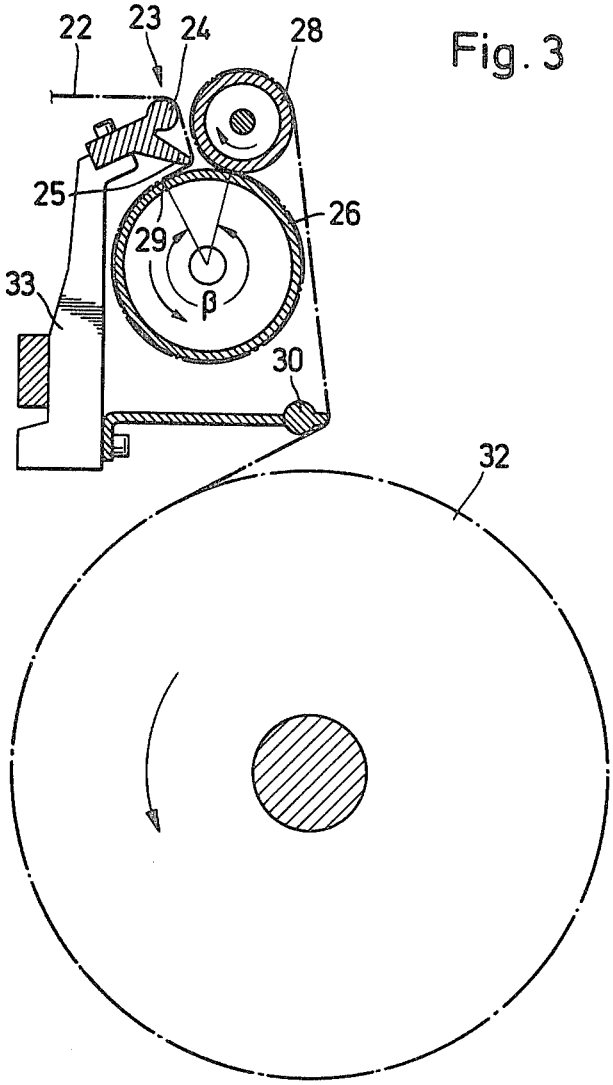
FIG. 3 illustrates a view taken on line III—III of FIG. 2.

Referring to FIGS. 1 and 3, the cloth take-up system also includes a take-up roller 26, a deflecting roller 28 of smaller diameter than the take-up roller 26 downstream of the take-up roller 26, a cloth guide 30 and a cloth beam 32 for winding of the cloth 22 thereon.

The breast beam 23 includes a first deflection element 24 which is disposed in the path of cloth travel as well as a second deflection element 25 which is disposed in the path of cloth travel below the first deflection element 24. As shown, this second deflection element 25 has a non-rotatable deflecting surface disposed between the deflection element 24 and the take-up roller 26 in order to deflect the cloth 22 towards the take-up roller 26 and thereby increase the wrapping angle $\beta$ of the cloth 22 about the take-up roller 26. To this end, the second deflection element 25 is disposed in a space defined by the take-up roller 26 and deflecting roller 28 and a tangential plane common to these rollers 26, 28. The wrapping angle of the cloth 22 about the take-up roller 26 is thus at a maximum value, for example over an angle greater than 280 degrees.

As shown in FIG. 3, the two deflection elements 24, 25 can be integrated into a one piece member, i.e. the breast beam 23. Such a member can be secured to vertical supports 33 of the weaving machine via suitable bolts or the like. Further, the two deflection elements 24, 25 may be constructed in the form of stationary friction strips. Advantageously, the cross-sectional shape of the one piece member is of a V or Y shape.

During operation, the take-up roller 26 is driven by a suitable drive (not shown) and the deflecting roller 28 is pressed into contact with the take-up roller 26. The cloth 22 which passes from the deflection elements 24, 25 initially contacts the roller 26 at the point 29 and wraps about the take-up roller 26 over the angle $\beta$ to the deflecting roller 28. The cloth 22 then passes from the deflecting roller 28 about the cloth guide 30 and is wound onto the cloth beam 32.

Figure 2:
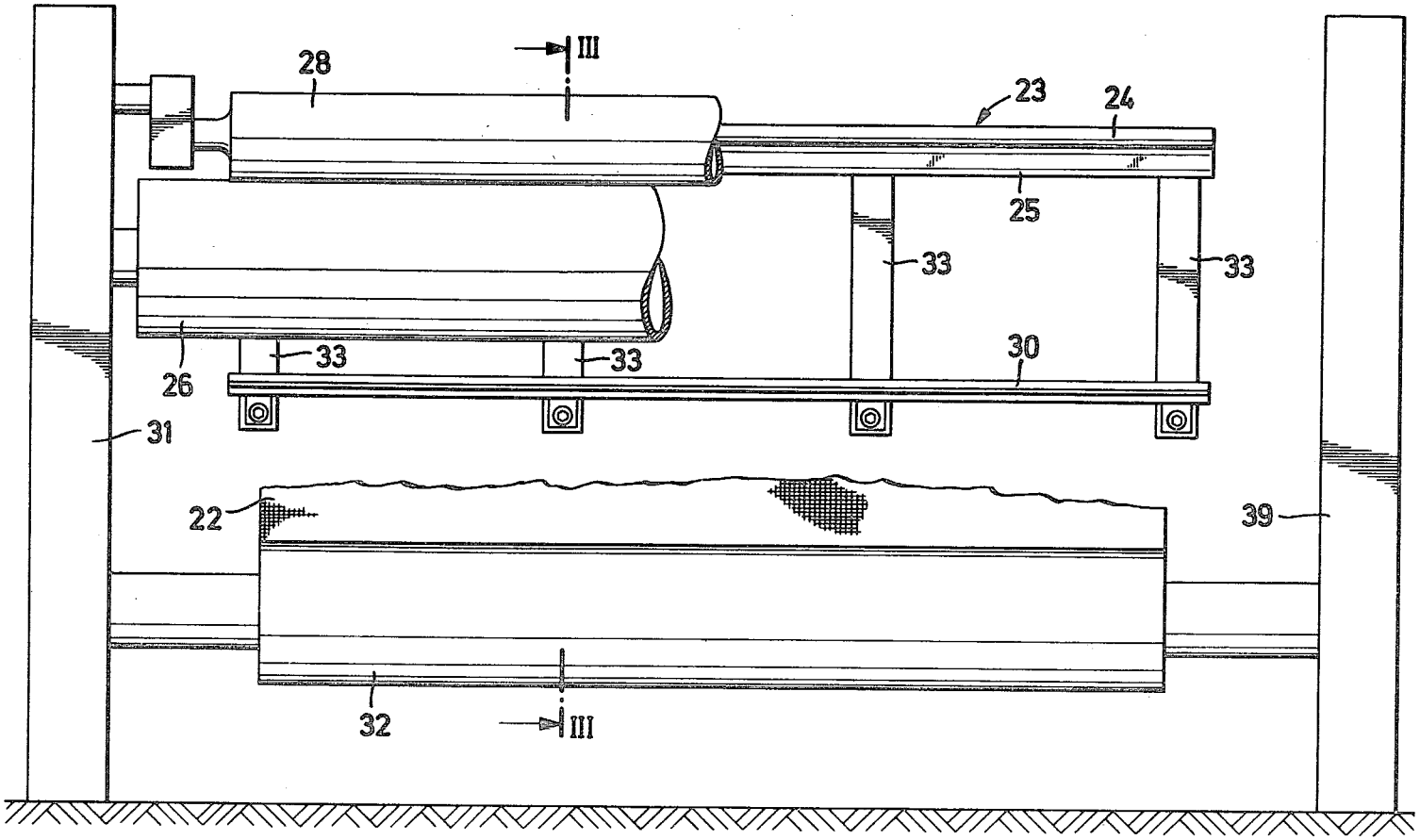
FIG. 2 illustrates a view of the take-up system of the weaving machine of FIG. 1 as viewed from the cloth side.

Referring now to FIG. 2, the various components of the take-up system can be supported in roller uprights 31, 39 as is known.

Figure 4:
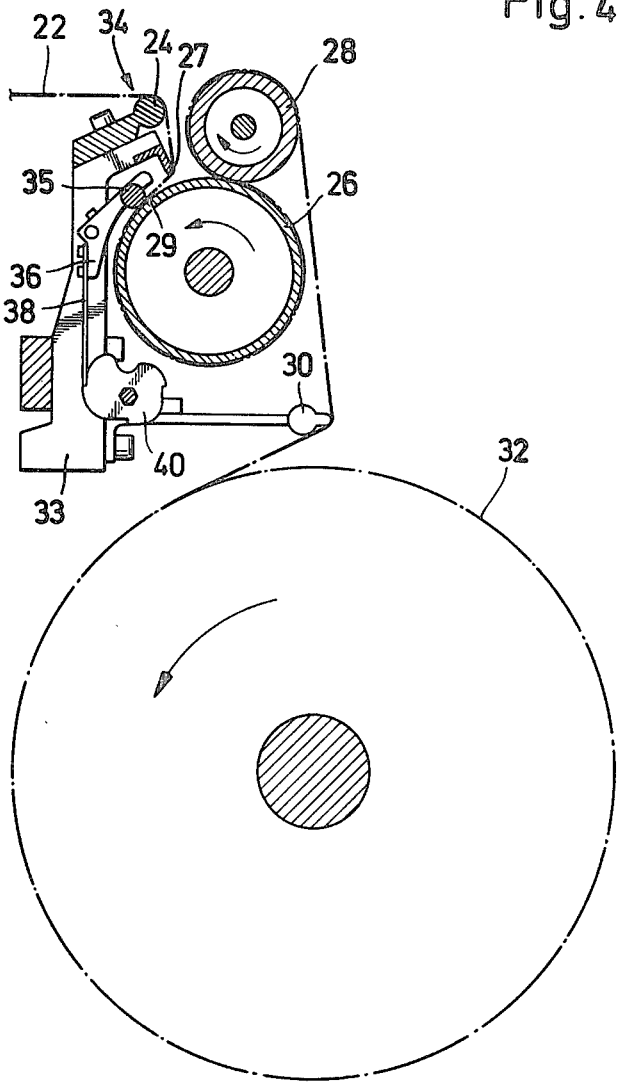
FIG. 4 illustrates a modified cloth take-up system having a contact-pressure element therein.

Referring to FIG. 4, wherein like reference characters indicate like parts as above, the take-up system may also employ a contact-pressure element 35 for pressing the cloth 22 against the take-up roller 26. As indicated, this contact-pressure element is in the form of a roller 35 which is separably mounted independent of the breast beam 34 and presses against the take-up roller 26 over the entire width of the cloth via levers 36 and springs 38. The contact pressure produced by the springs 38 can be adapted to the technical weaving requirements at any time by means of eccentric cams 40. As shown, the levers 36 are pivotally mounted on the vertical supports 33 below the breast beam 34 and carry the springs 38. The cams 40 are suitably mounted on the supports 33 so as to effect adjustments in the position of the levers 36 and the pressure of the springs 38.

By suitably adjusting the cams 40, the anti-slip effect of the cloth 22 on the take-up roller 26 is enhanced.

Instead of using a roller 35, the contact-pressure element may be in the form of a resilient tube, for example of plastic. Such a tube may be held, for example, in a U-shaped rail (not shown). It is also possible to use a friction strip, for example of a corresponding profile of plastic material.

As shown in FIG. 4, the second deflection element 27 may be separably mounted from the first deflection element 24. In this case, the second deflection element 27 may be a friction strip which is of L-shaped profile and which is mounted below the first deflection element of the breast beam 34.

What is claimed is:

1. A cloth take-up system for taking-up a travelling length of cloth in a weaving machine comprising a first cloth deflection element disposed in the path of cloth travel;

a cloth take-up roller located below said first cloth deflection element;

a deflecting roller downstream of said take-up roller relative to the direction of cloth travel, said deflecting roller being disposed above said take-up roller;

a cloth beam below said take-up roller for winding of the cloth thereon; and a second cloth deflection element having a non-rotatable deflecting surface disposed in the path of travel of the cloth between said first deflection element and said take-up roller to deflect the cloth towards said take-up roller and said deflecting roller and increase the wrapping angle of the cloth about said take-up roller.

2. A cloth take-up system as set forth in claim 1 wherein said first and said second deflection elements are integrated into a one-piece member.

3. A cloth take-up system as set forth in claim 2 wherein said member has a V-shaped cross-section to define said elements.

4. A cloth take-up system as set forth in claim 2 wherein said member has a Y-shaped cross-section to define said elements.

5. A cloth take-up system as set forth in claim 1 wherein said second deflection element is disposed in a space defined by said take-up roller, said deflecting roller and a tangential plane common to said rollers.

6. A cloth take-up system as set forth in claim 1 which further comprises a contact-pressure element for pressing the cloth against said take-up roller.

7. In a weaving machine having means for forming a cloth, the combination comprising a take-up roller for receiving a travelling length of cloth;

a first deflection element adjacent said take-up roller to direct the travelling length of cloth to said take-up roller;

a deflecting roller adjacent and above said take-up roller for receiving the travelling length of cloth from said take-up roller; and a second deflection element having a non-rotatable deflecting surface disposed in the path of travel of the cloth between said first deflection element and said take-up roller to deflect the cloth towards said take-up roller and said deflecting roller and increase the wrapping angle of the cloth about said take-up roller.

8. The combination as set forth in claim 7 wherein said second deflection element is disposed in a space defined by said take-up roller, said deflecting roller and a tangential plane common to said rollers.

9. The combination as set forth in claim 7 wherein said second deflection element and said deflecting element and said deflecting roller are positioned relative to said take-up roller to wrap the travelling length of cloth about said take-up roller over an angle greater than 280 degrees.

10. The combination as set forth in claim 7 wherein said second deflection element is fixedly mounted.

11. The combination as set forth in claim 7 wherein said deflecting roller is of smaller diameter than said take-up roller.

12. The combination as set forth in claim 11 wherein said second deflection element is fixedly mounted and disposed in a space defined by said rollers and a tangential plane common to said rollers, and wherein said second deflection element and said deflecting roller are positioned relative to said take-up roller to wrap the travelling length of cloth about said take-up roller over an angle greater than 280 degrees.

13. The combination as set forth in claim 12 which further comprises a contact-pressure element between said second deflection element and said take-up roller for pressing the travelling cloth against said take-up roller.

14. The combination as set forth in claim 7 which further comprises a contact-pressure element between said second deflection element and said take-up roller for pressing and travelling cloth against said take-up roller.

* * * * *

UNITED STATES PATENT AND TRADEMARK OFFICE

CERTIFICATE OF CORRECTION

PATENT NO. : 4,192,353
DATED : March 11, 1980
INVENTOR(S) : Otto Hintsch

It is certified that error appears in the above—identified patent and that said Letters Patent is hereby corrected as shown below:

Column 2, line 56, after "Referring" delete --now--

Column 4, line 52, change "and" to --the--

Signed and Sealed this

*Twenty-second* Day of *July 1980*

[SEAL]

*Attest:*

SIDNEY A. DIAMOND

*Attesting Officer*

*Commissioner of Patents and Trademarks*